US005415584A

United States Patent [19]

Brooke et al.

[11] Patent Number: 5,415,584

[45] Date of Patent: May 16, 1995

[54] PARTICLE BLAST CLEANING APPARATUS

[75] Inventors: Robert K. Brooke, Snellville; Robert W. Schmucker; Joseph J. Schmucker, both of Warner Robins, all of Ga.

[73] Assignee: TOMCO$_2$ Equipment Company, Loganville, Ga.

[21] Appl. No.: 124,712

[22] Filed: Sep. 21, 1993

[51] Int. Cl.[6] ..... B08B 7/00

[52] U.S. Cl. ..... 451/99; 451/90; 451/91; 451/38; 451/39; 134/7

[58] Field of Search ..... 451/90, 91, 94, 96, 451/99, 100, 101, 102, 38, 39, 40; 137/7, 11, 12, 13

[56] References Cited

U.S. PATENT DOCUMENTS

| | | | |
|---|---|---|---|
| 561,483 | 6/1896 | Bryce . | |
| 2,421,753 | 6/1947 | Joyce . | |
| 3,110,983 | 11/1963 | Moore | 51/9 |
| 3,137,101 | 6/1964 | Leliaert | 51/13 |
| 3,160,993 | 12/1964 | McCormick | 51/9 |
| 3,272,396 | 9/1966 | Neville | 222/194 |
| 3,324,605 | 6/1967 | Lester | 51/314 |
| 3,422,580 | 1/1969 | Balz | 51/314 |
| 3,485,074 | 12/1969 | Compton | 72/53 |
| 3,548,543 | 12/1970 | Evans et al. | 51/8 |
| 3,676,963 | 7/1972 | Rice et al. | 51/320 |
| 3,702,519 | 11/1972 | Rice et al. | 51/310 |
| 3,768,210 | 10/1973 | Johnson et al. | 51/12 |
| 3,933,165 | 1/1976 | Budzak et al. | 137/625.48 |
| 4,038,786 | 8/1977 | Fong | 51/320 |
| 4,333,277 | 6/1982 | Tasedan | 51/425 |
| 4,339,897 | 7/1982 | Thompson et al. | 51/436 |
| 4,617,064 | 10/1986 | Moore | 51/320 |
| 4,655,847 | 4/1987 | Ichinoseki et al. | 51/410 |
| 4,744,181 | 5/1988 | Moore et al. | 51/436 |
| 4,947,592 | 8/1990 | Lloyd et al. | 51/436 |
| 4,977,910 | 12/1990 | Miyahara et al. | 51/320 |

FOREIGN PATENT DOCUMENTS

| | | |
|---|---|---|
| 79693 | 5/1918 | Switzerland . |
| 565260 | 6/1944 | United Kingdom . |

*Primary Examiner*—Bruce M. Kisliuk
*Assistant Examiner*—Eileen P. Morgan
*Attorney, Agent, or Firm*—Deveau, Colton & Marquis

[57] ABSTRACT

A particle blast cleaning apparatus for use with sublimable blast media, a source of compressed gas, and a discharge nozzle. The apparatus includes a mixing device for mixing the sublimable media with compressed gas, which mixing device includes a lower section having an outlet port formed therein and an upper section positioned over the lower section and having two sublimable media inlet ports and a compressed gas inlet port. A transfer member is mounted between the lower section and the upper section for reciprocal movement and has at least two transfer chambers for transporting sublimable media. A control mechanism is provided for controlling the flow of compressed gas to the compressed gas inlet port such that compressed gas is only provided to the compressed gas inlet port when at least one of the transfer chambers is in fluid communication with the compressed gas inlet port.

23 Claims, 6 Drawing Sheets

PARTICLE BLAST CLEANING APPARATUS

TECHNICAL FIELD

The present invention relates to a particle blast cleaning apparatus and more particularly to an improved apparatus for use with sublimable particles.

BACKGROUND OF THE INVENTION

Particle blast cleaning apparatuses are well known in the art and it is known to use various types of blast media, such as ordinary sand, tiny glass beads, walnut shells, peanut husks, etc. One difficulty with these types of media is that the spent media can be difficult and time consuming to clean up.

At least partially due to the difficulty of gathering and disposing of the spent media, the art has turned to the use of sublimable particles as a blast media. Specifically, it has become known that carbon dioxide ($CO_2$) ice (i.e., "dry ice") can be used as a blast media. Dry ice, being in solid form, acts as a good abrasive media. After being spent during the cleaning operation, the dry ice simply evaporates and leaves nothing to be cleaned up other than the residue which has been abraded from the surface of the object being cleaned. This substantially reduces the task of cleaning up after the blast cleaning operation. Unfortunately, dry ice exists at extremely low temperatures, such as below more than −100° F. This proves to present certain practical difficulties when the extremely cold blast media is used in the blast equipment. The dry ice rapidly absorbs heat from the surrounding equipment, thereby substantially lowering the temperature of the equipment. This can result in the formation of ice condensation on the outside or inside of the equipment and can, through thermal contraction, substantially change the dimensions of critical components of the device.

Various efforts have been made in the art to provide a workable sublimable media blast cleaning apparatus. One of the difficulties encountered in the art is reliably mixing or entraining dry ice particles in a fast flowing stream of compressed air. In general, two arrangements are typical in the art. In one arrangement, a rotary pellet transport arrangement communicates dry ice pellets with a high pressure gas stream through the use of a discharge nozzle. Such an arrangement is generally disclosed in U.S. Pat. No. 4,617,064 of Moore. In a typical rotary arrangement, cavities are formed in a rotating member which then rotates in sequence between a receiving station and a discharge station to transport dry ice pellets from the receiving station to the discharge station where they are entrained in the air. Another such rotary arrangement is shown in U.S. Pat. No. 4,947,592 of Loyd, et al.

In another type of arrangement known in the art, a plurality of feeder bars move back and forth in linear fashion to collect dry ice pellets and transport them from an inlet to an outlet where they are entrained in the high speed air flow. Such an arrangement is shown in U.S. Pat. No. 4,744,181 of Moore, et al. The '181 Moore, et al. arrangement generally suffers from having a large number of moving pans, thereby being rather complex. Because of the low temperatures attendant upon the use of dry ice, mechanical complexity should be avoided in order to maintain good reliability.

In general, among the problems experienced in the art are: (1) maintaining a relatively uniform flow of dry ice particles and evenly mixing the dry ice particles with the flow of compressed air; and (2) providing a device that operates reliably without "freeze up". It is to the provision of such an apparatus that overcomes these problems that the present invention is primarily directed.

SUMMARY OF THE INVENTION

Briefly described, in a preferred form the present invention comprises an apparatus for particle blast cleaning, and in particular, for use with sublimable particle media. The apparatus includes a hopper for storing and providing a supply of dry ice pellets and an improved mixing device for mixing the dry ice pellets with compressed gas flowing from a suitable source of compressed gas, such as a compressor.

The improved mixing device includes first and second dry ice inlets and a compressed gas inlet. A slide bar is mounted for reciprocal movement relative to these dry ice inlets and the compressed gas inlet so as to selectively align one of a plurality of transfer chambers formed in the slide bar with the dry ice inlet ports or the compressed gas inlet port. Preferably, the compressed gas inlet port is positioned in between the two dry ice inlet ports so that, in operation, as the slide bar reciprocates back and forth, a charge of dry ice pellets is entrained in the compressed gas each time one of the transfer chambers becomes aligned with the compressed gas inlet port. This results in relatively smooth flow of the dry ice pellets, resulting in improved blast cleaning.

The apparatus preferably includes control means for controlling the supply of compressed gas provided to the compressed gas inlet port such that compressed gas is only provided to the compressed gas inlet port when one of the transfer chambers in the slide bar is in fluid communication with the compressed gas inlet port. The advantage of this arrangement is that it minimizes backflow of compressed gas into the dry ice storage hopper.

The mixing device preferably also includes an improved dynamic seal. In the preferred dynamic seal according to the present invention, upper and lower bearing strips are placed above and below the slide bar. These bearing strips are held snugly against the slide bar by means of a movable upper block assembly which is held down by a plurality of air cylinders. The air cylinders tend to gently squeeze the beating strips against the transfer bar, thereby providing good sealing, good alignment, and good bearing action. This also has the advantage of automatically compensating for wear in the beating material.

Prefereably, the compressed gas is compressed air. However, in some operating environments, nitrogen gas, or other gas, may be cheaper and/or more readily available.

Preferably, the mixing device also includes an improved exhaust manifold wherein the initial mixture of the dry ice pellets and compressed gas as delivered from the slide bar is mixed yet again with a larger volume of compressed gas in a manner such that the initial mixture is introduced at a slightly higher pressure than the clean compressed gas within the exhaust manifold. This reduction in "back pressure" prevents the clean compressed gas from traveling back up the path normally taken by the initial mixture of compressed gas and dry ice pellets. This tends to provide for more even and unrestricted flow of the initial mixture of compressed gas and dry ice pellets into the exhaust manifold. This results in more reliable mixing and blasting.

Accordingly, it is an object of the present invention to provide an improved particle blast cleaning apparatus which is simple in construction, durable in use, and economical in manufacture.

It is another object of the present invention to provide an improved particle blast cleaning apparatus which achieves relatively uniform flow of media.

It is another object of the present invention to provide an improved particle blast cleaning apparatus which is extremely durable in use, despite the relatively rigorous demands placed upon the apparatus by the use of dry ice as the media.

These and other objects, advantages, and features of the present invention will become apparent to those skilled in the art upon reading the following specification in conjunction with the accompanying drawings.

BRIEF DESCRIPTION OF THE DRAWING FIGURES

DETAILED DESCRIPTION

Figure 1:
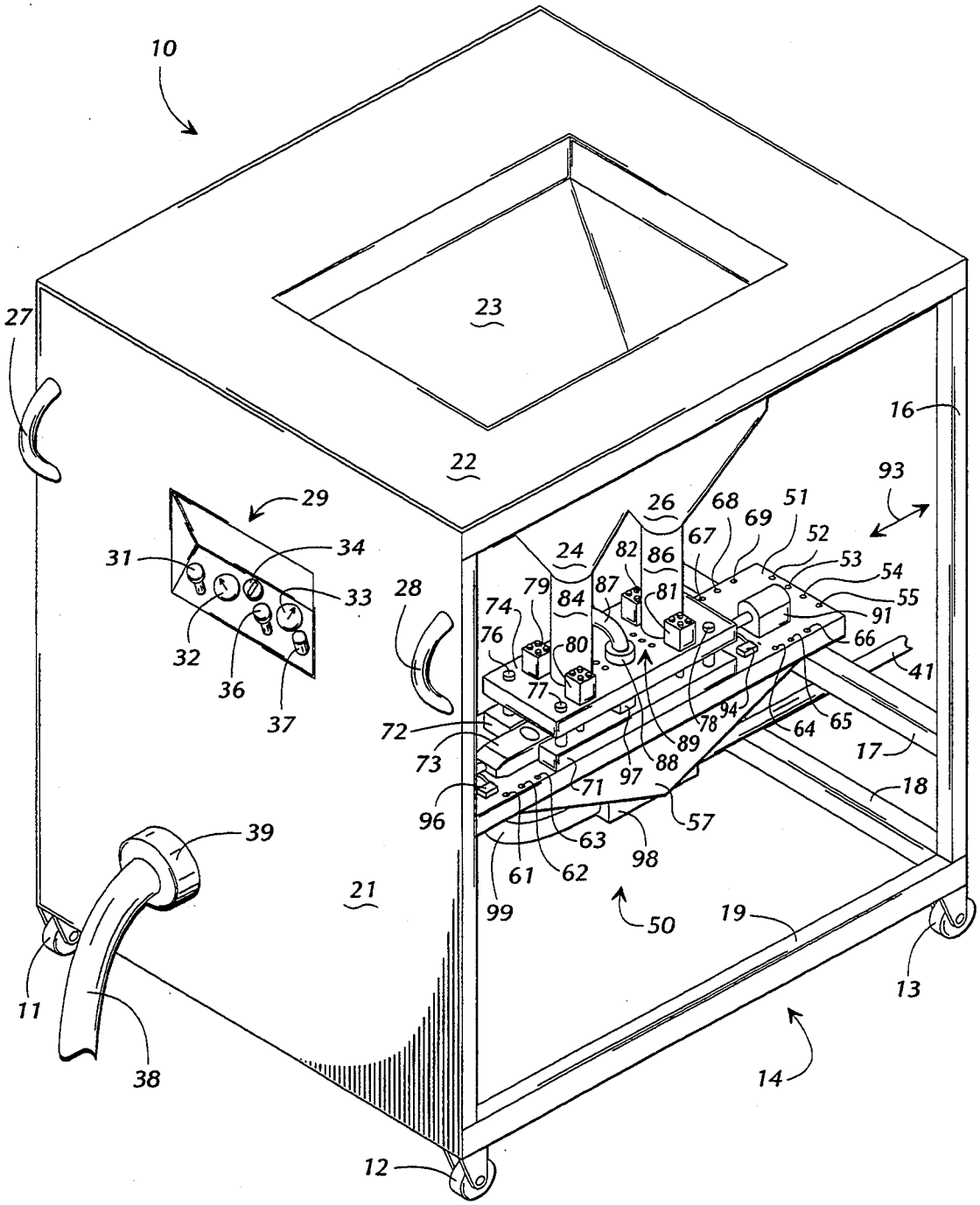
FIG. 1 is a perspective, schematic illustration of a particle blast cleaning apparatus according to a preferred form of the invention.

Referring now in detail to the drawing figures, wherein like reference numerals represent like parts throughout the several views, FIG. 1 schematically depicts an improved particle blast cleaning apparatus 10 according to a preferred form of the invention. The apparatus 10 preferably can be made on a portable frame, as shown, including ground engaging casters 11, 12, and 13 for supporting a support frame assembly 14 above the ground or the floor. The support frame assembly as depicted preferably can include upright stanchions and lateral beams 16, 17, 18, and 19 constructed of rectangular steel tubing. Of course, other well-known construction techniques are possible.

External panels, such as panel 21 and top panel 22, are secured to the support frame assembly with suitable fasteners (unshown). These removable panels provide easy access to the working components of the apparatus 10 for service and repair. In FIG. 1, two of the side panels and one of the end panels are not illustrated in order to show the details of the operative portion of the device. Also not shown is a hinged lid for covering the large hopper 23, which hopper is provided for storing a suitable quantity of dry ice pellets. The hopper 23 converges to two (2) discharge cones 24 and 26. Dry ice pellets flowing from the interior of the hopper 23 through the discharge cones 24 and 26 are fed into the mixing apparatus, which will be described in more detail below.

The apparatus includes two large handles 27 and 28 for moving the apparatus about and a recessed control panel 29 positioned in the end panel 21. The control panel 29 includes a push valve 31 for switching between compressed air only and compressed air mixed with dry ice pellets. The control panel also includes a main air pressure gauge 32 and a control air pressure gauge 33. An on/off switch 34 is centrally located and positioned next to an emergency stop button 36. A rotary valve 37 is provided for adjusting the speed of the stroke of air cylinders in the mixing apparatus, thereby controlling the rate of pellet discharge.

As depicted in FIG. 1, the apparatus 10 is supplied with compressed air from a suitable source, such as a compressor, through a large supply hose 38 connected to the apparatus via a coupling 39. After dry ice pellets are entrained in the compressed air, the mixture of compressed air and dry ice pellets is delivered to an unshown nozzle or gun through delivery conduit 41.

Figure 2:
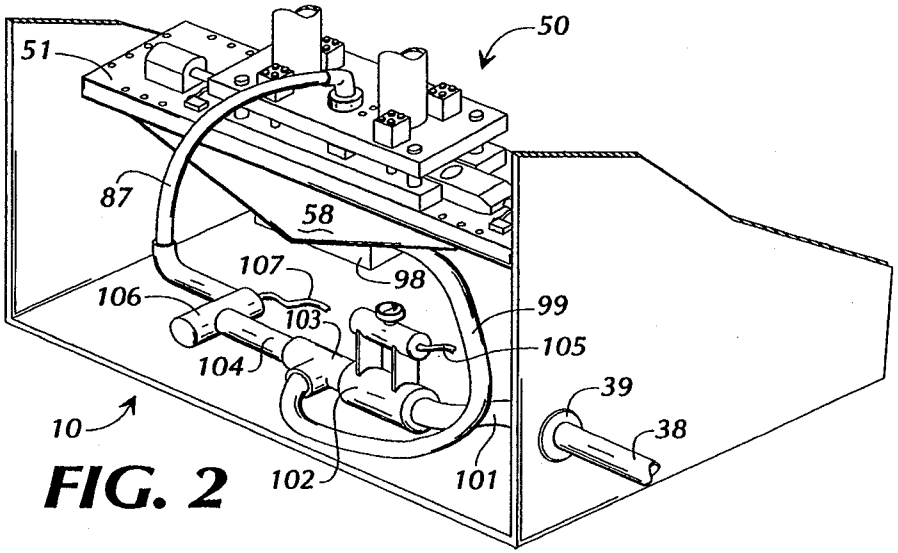
FIG. 2 is a perspective, schematic view of a portion of the apparatus of FIG. 1.

The apparatus 10 also includes a mixing device indicated generally at 50. The mixing device 50 is mounted to the support frame assembly 14 and positioned beneath the hopper 23. The mixing device 50 includes a rectangular, substantially fiat platform or support deck 51 extending between beam 17 and an unshown beam at the opposite end of support frame assembly 14. The platform or deck 51 can be secured to the beam 17 by well known techniques, such as welding or, as in the case depicted in FIG. 1, by fasteners 52–55. The platform or deck 51, being relatively thin in the vertical direction, would normally be given to a certain amount of deflection due to weight and mechanical forces. To stiffen the deck 51 against unwanted deflection, reinforcing stiffeners or webs 57 (see FIG. 1) and 58 (see FIG. 2) are secured to the deck by fasteners 61–69 depicted in FIG. 1. While the webs 57 and 58 are shown as being generally triangular, they can be rectangular to minimize their height.

A pair of intermediate bolster blocks or side rails 71 and 72 are formed in or otherwise secured to the deck 51 and extend generally parallel to each other along a portion of the length of the deck 51. By virtue of the intermediate blocks 71 and 72 being spaced apart from one another, a channel is formed between them for receiving a transfer bar 73. Positioned above the transfer bar 73 and the intermediate blocks 71 and 72 is an upper plate or upper section 74. The upper plate 74 is secured to the deck 51 and the intermediate blocks 71 and 72 by four guide pins, such as guide pins 76, 77, and 78. These guide pins ride in close-fitting bores formed in the upper plate 74 and allow the upper plate 74 to be moved up and down while maintaining close registration of the upper plate 74 relative to the intermediate blocks 71 and 72. The upper plate 74 is urged or biased downwardly toward the deck 51 and the intermediate blocks 71 and 72 by four air cylinders, such as air cylinders 79, 80, 81, and 82. Together, the guide pins and the air cylinders provide part of a dynamic seal which will be discussed in more detail later in the specification.

A pair of dry ice inlet conduits 84 and 86 extend between the discharge cones 24 and 26 of the hopper 23 and the upper plate 74. A compressed air supply line 87 is coupled to the upper plate 74 with a coupling 88.

Two triplets of air pressure relief vents, such as triplet 89, are formed in the upper plate 74 for relieving or venting air pressure that may be otherwise trapped in the transfer chambers (to be discussed later) in the transfer bar 73.

A pair of air cylinders 91 and 92 (see FIG. 3) are coupled to the ends of the transfer bar 73 for pulling the transfer bar back and forth in the direction of double-headed direction arrow 93 (FIG. 1). Limit switches or proximity sensors 94 and 96 are positioned generally adjacent the air cylinders 91 and 92 for detecting the desired ends of the stroke of the transfer bar 73 so as to reverse direction. In this regard, it should be understood that the air cylinders 91 and 92 are each operated in a "pull" mode only. It is considered that by pulling only with each cylinder, better alignment of the transfer bar 73 within its travel path can be obtained, thereby minimizing wear and tear on the various components. Alternatively, only one cylinder could be provided and operated in a "push-pull" mode. Optionally, one can provide guide rollers (unshown) to help keep the transfer bar aligned along the desired path of movement.

Another limit switch 97 is positioned roughly centrally between the air cylinders 91 and 92 and between the upper plate 74 and the deck 51 for sensing when the transfer bar 73 is in such position to allow passage of pressurized air through the supply line 87, through the transfer bar 73 and outwardly to an exhaust manifold 98. The exhaust manifold 98 is positioned beneath the deck 51 between the webs 57 and 58. In addition to being connected with the outlet from the mixing device 50, the exhaust manifold 98 also is connected with raw compressed air via inlet conduit 99.

Referring again to FIG. 2, some details of the air supply plumbing will be considered. As previously described, the main supply of air to the apparatus 10 is provided through supply hose 38 connecting with coupling 39. Internally of the apparatus, this high pressure air is communicated through a first hose 101 to a ball valve 102. Output from the ball valve 102 is provided to the exhaust manifold 98 via inlet conduit 99. Of course, the inlet conduit 99 is an inlet for the exhaust manifold 98 and acts as an outlet conduit for a T-junction 103 coupled to the ball valve 102. The ball valve 102 is controlled by a pneumatic control line 105. Another outlet from the T-junction 103 is a conduit 104 communicating with a two-position spool valve 106. This spool valve is controlled by a pneumatic control line 107. The output from this spool valve is routed to the compressed air supply line 87 which feeds the mixing device 50 with compressed air.

Figure 3:
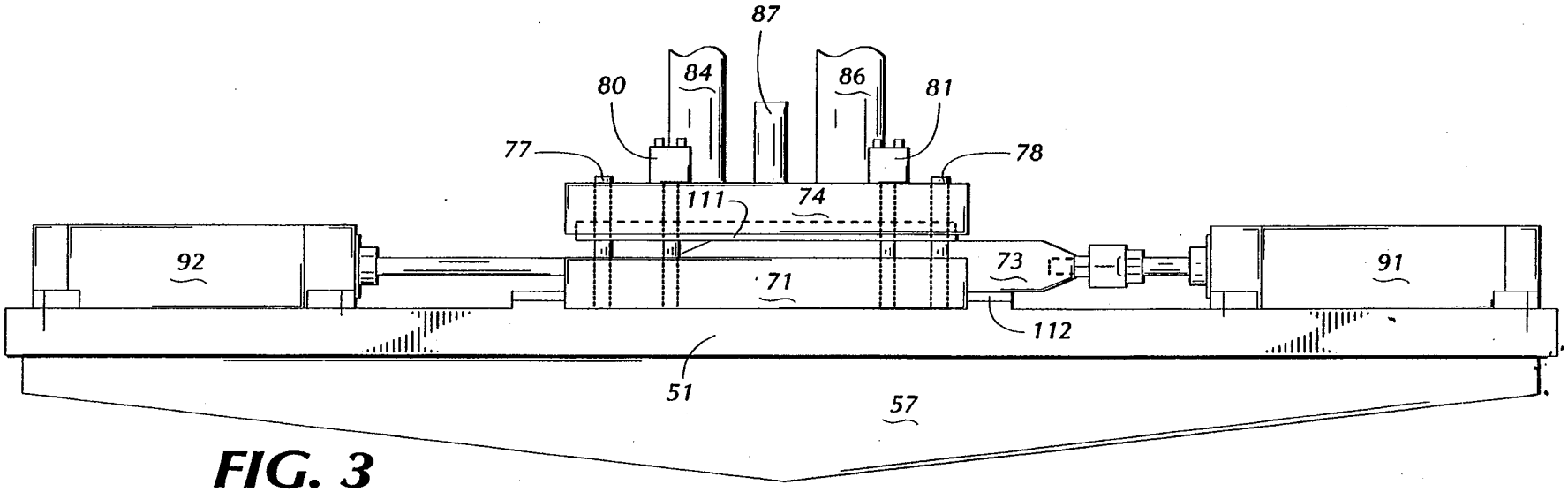
FIG. 3 is a schematic, side elevation view of a portion of the apparatus of FIG. 1.

Referring now specifically to FIG. 3, the details of the dynamic seal can be more fully considered. As previously described, the upper plate 74 is movably located above the deck 51 and the intermediate blocks 71 and 72 (72 unshown in FIG. 3) by means of guide pins, such as guide pins 77 and 78, and clamping air cylinders, such as air cylinders 80 and 81. FIG. 3 further shows the use of sealing strips or bearing strips, such as upper bearing strip 111 and lower bearing strip 112. These beating strips 111 and 112 straddle the transfer bar 73 so that as the clamping air cylinders squeeze the upper plate toward the deck 51, the bearing strips 111 and 112 snugly engage the transfer bar 73 to provide a fluid seal. The beating strips, which are subjected to extremely low temperatures in operation of the device, preferably are made from self-lubricating material. Preferably, this self-lubricating bearing material is of a plastic or composite non-ferrous composition. The transfer bar 73 is specially treated for long wear by hard anodized treatment wherein a Teflon® supplementary impregnation is provided. The dynamic seal constantly adjusts for dimensional changes in the unit as the apparatus goes from ambient temperature to operating temperatures (which are quite low). This helps to keep the seal intact and to facilitate the induction of the pellets into the air stream, while keeping foreign matter out of the operating mechanism. This results in an extremely long-wearing seal.

Figure 4A:
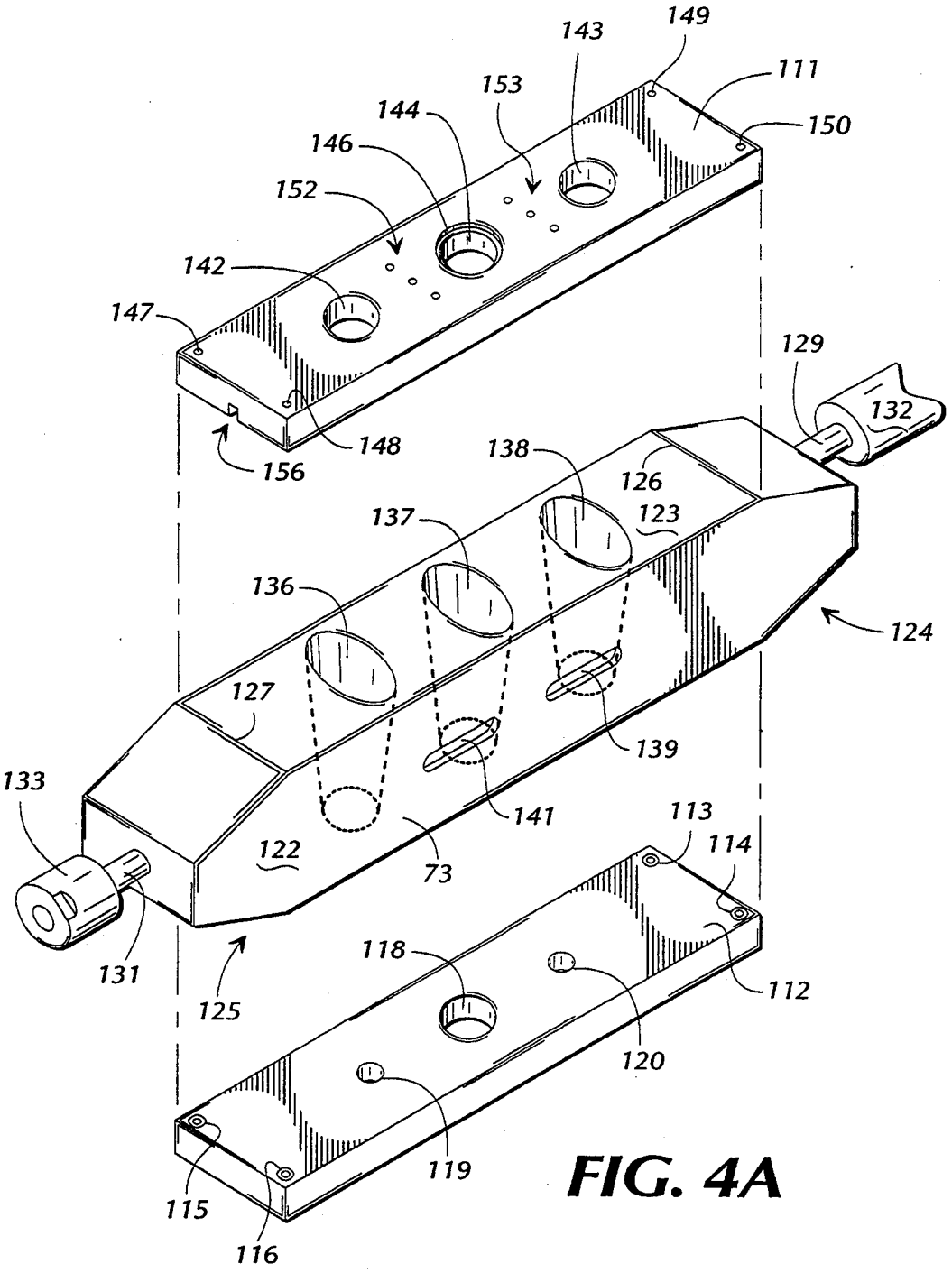
FIG. 4A is a schematic, exploded view of a portion of the apparatus of FIG. 1.

Details of the upper bearing strip 111 and the lower bearing strip 112 can be seen in FIG. 4A. In FIG. 4A, the bearing strips 111 and 112 and the transfer bar 73 are depicted in an exploded view substantially as in the arrangement in which they are placed in the assembled device (with the exception of these items being depicted apart from one another). The lower strip 112 and the upper strip 111 are in the form of relatively thin rectangular strips of beating material. Lower strip 112 includes four mounting holes 113–116 for securing the lower bearing strip to the deck or platform 51 with unshown fasteners. A large outlet port 118 is provided roughly in the middle of the bearing strip 112. When the bearing strip 112 is installed, the outlet port 118 is vertically aligned with the compressed air inlet 87 so that the compressed air may be passed through the transfer bar 73 and out through the outlet port 118. A pair of small air pressure relief holes or vents 119 and 120 are provided in the lower strip 112 to relieve unwanted pressure from the transfer chambers (to be discussed later) to facilitate the filling of the chambers with dry ice pellets.

Now considering the transfer bar 73, one can see that it is an elongate, substantially rectangular cross-section solid block of material, preferably machined from aluminum and then hard coat anodized and Teflon® impregnated. Alternatively, the transfer bar 73 could be cylindrical and could ride in a smooth bore. The four longitudinal exterior faces, such as faces 122 and 123, are perpendicular to adjacent ones of each other. The ends, 124 and 125, of the transfer bar are chamfered. Alternately, these could be smoothly rounded to avoid a sharp edge, such as the sharp edges 126 and 127. Swivel-ended threaded studs 129 and 131 are threaded into the end of the transfer bar 73. The ends of these swivel studs are received in swivel sockets 132 and 133. In turn, these swivel sockets are threaded for receiving the piston rods of the air cylinders 91 and 92 (see FIG. 3 ).

The transfer bar 73 includes three transfer chambers or transfer passageways 136, 137, and 138. These passageways extend from the upper surface 123 completely through the transfer bar 73 to the opposite face. As is depicted in FIG. 4A, these transfer chambers taper from a generally football-shaped or ovoid-shaped top to a circular or round-shaped bottom. The advantage of this tapered arrangement is that it facilitates the introduction of dry ice pellets into the chamber. In applications where extremely gentle blasting is desired, one can eliminate the taper in the transfer bar transfer chamber so that only smaller amounts of dry ice pellets are introduced into the transfer chamber, thereby decreasing the amount of abrasive media delivered. Looking at the ovoid or football-shaped openings, the minor axis thereof closely corresponds to the diameter of the outlet port 118 and the inlet port, to be discussed below, of the upper bearing strip 111.

A pair of detents 139 and 141 are formed in the side face 122 of the transfer bar 73. These detents 139 and 141 together with the flat face 122, act as a sort of cam surface for a roller attached to a limit switch, to be discussed in more detail below. These detents are longitudinally positioned between the transfer chambers 136, 137, and 138.

The upper bearing strip 111, shown in its installed orientation in FIG. 4A, is a thin, rectangular strip of bearing material, as previously described. The upper beating strip 111 includes first and second dry ice inlet ports or apertures 142 and 143. A compressed air inlet port 144 is positioned between the dry ice inlet ports 142 and 143. The compressed air inlet port 144 is provided with a recess or counterbore 146 for receiving an O-ring for sealing the compressed air inlet port 144 to the upper plate 74. The upper bearing strip 111 is secured to the upper plate 74 with unshown fasteners mounted through fastener holes 147, 148, 149, and 150. Alternatively, the upper and lower bearing strips 111 and 112 can be made to have a T-shape cross section and then secured in T-slots formed in the upper plate and in the deck, thereby eliminating the fastener holes 147–150 and their associated fasteners.

Figure 4B:
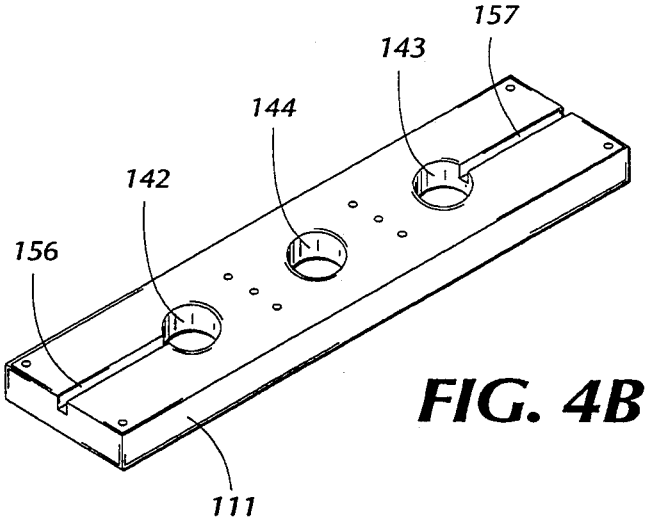
FIG. 4B is a perspective illustration of a portion of the apparatus of FIG. 4A, with the portion shown in FIG. 4B illustrated upside down to show additional details.

The upper bearing strip 111 also includes two triplets 152 and 153 of small air pressure relief vents for relieving unwanted pressure from within the transfer chambers 136, 137, and 138. Also, the upper bearing strip 111 includes longitudinal pressure relief channels 156 and 157 formed in the underside portion of the upper bearing strip 111, as depicted in FIG. 4B. In FIG. 4B, the upper bearing strip 111 is shown turned upside down to reveal the details of the longitudinal pressure relief channels. The channels 156 and 157 vent unwanted pressure from the transfer chambers, when the transfer chambers individually are in fluid communication with the dry ice inlet ports 142 and 143, by communicating unwanted pressure longitudinally and away from the transfer chambers.

Figure 5:
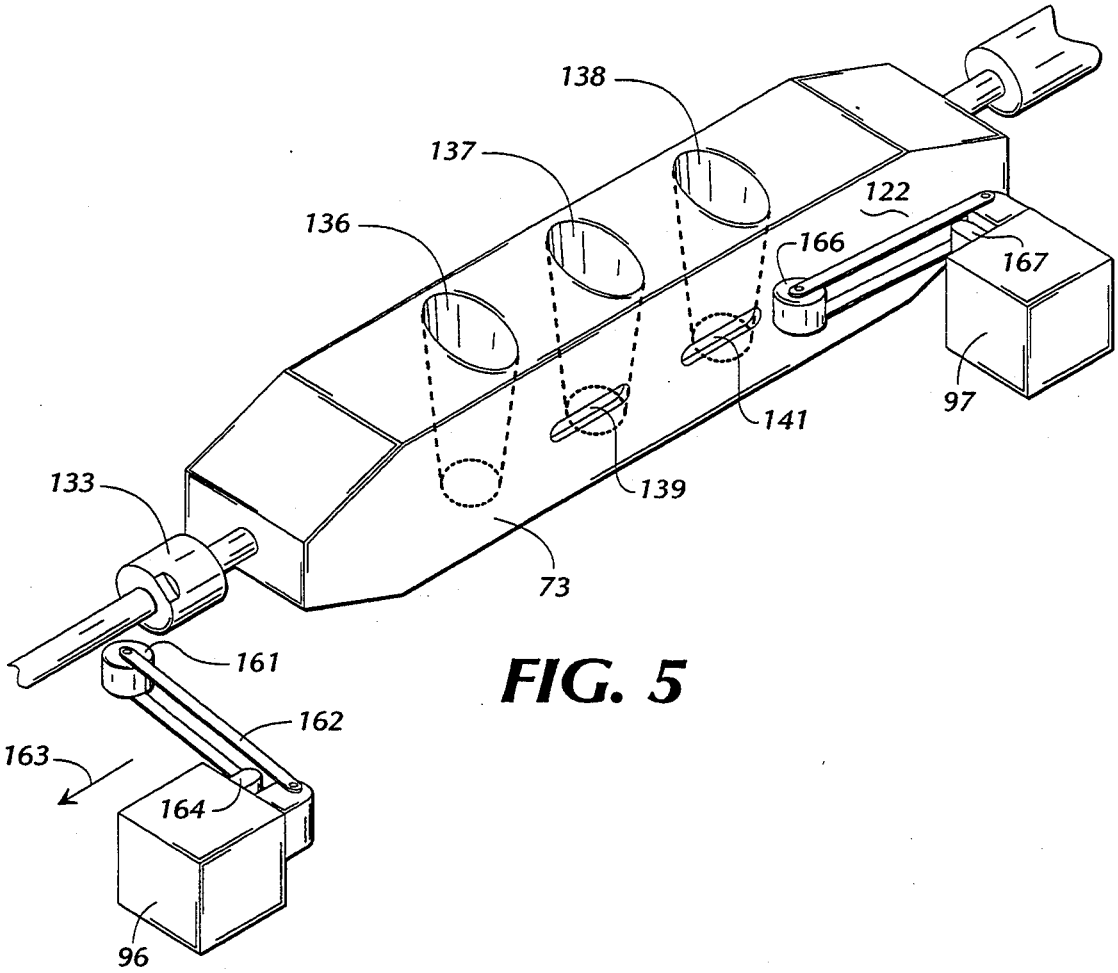
FIG. 5 is a schematic illustration of a transfer bar portion of the apparatus of FIG. 1, shown in conjunction with proximity switches.

FIG. 5 shows the interaction of the limit switches, such as limit switch 96 and limit switch 97, with the transfer bar 73. When the transfer bar 73 moves the desired stroke to the left, a front face of the swivel socket 133 contacts a roller 161 of the limit switch 96, thereby moving the roller and the arm 162 to which it is attached in the direction of direction arrow 163. This causes switch button 164 to be depressed which creates a signal which is used to trigger the shutting off of air pressure to air cylinder 92 to stop this air cylinder from continuing to pull the transfer bar in this direction. At the same time, air pressure is communicated to air cylinder 91 to cause it to pull the transfer bar in the opposite direction. Limit switch 94 (unshown in FIG. 5) operates in substantially the same manner to control travel toward air cylinder 91 and to reverse the direction yet again.

FIG. 5 also shows the arrangement and use of a limit switch 97 for sensing the position of the transfer bar 73. By placing the limit switch 97 in the affixed position, appropriately located so that the roller 166 of the limit switch is aligned with the compressed air inlet port, the limit switch 97 can be used to indicate whether one of the transfer chambers 136–138 are aligned with the inlet port. In this regard, the roller rides on the side face 122 of the transfer bar 73 and as the transfer bar 73 moves back and forth, the roller alternately rides on the face 122 or falls into the recesses or detents 141 and 139. As previously described, the recesses or detents 141 and 139 are positioned to be between the transfer chambers 136. 137, and 138. As a result, when the roller 166 falls into these detents, this indicates that the transfer chambers are not aligned with the compressed air inlet port. Thus, when trigger button 167 is not depressed, this is an indication that no compressed air can be blasted through the transfer chambers and this information is used to shut off the supply of compressed air to the compressed air inlet port 87 using valve 106. When trigger button 167 is depressed, this indicates that one of the transfer chambers 136–138 is aligned with the compressed air inlet 87 and the information is used to operate valve 106 to provide compressed air through the inlet port and through the aligned transfer chamber.

Figure 6:
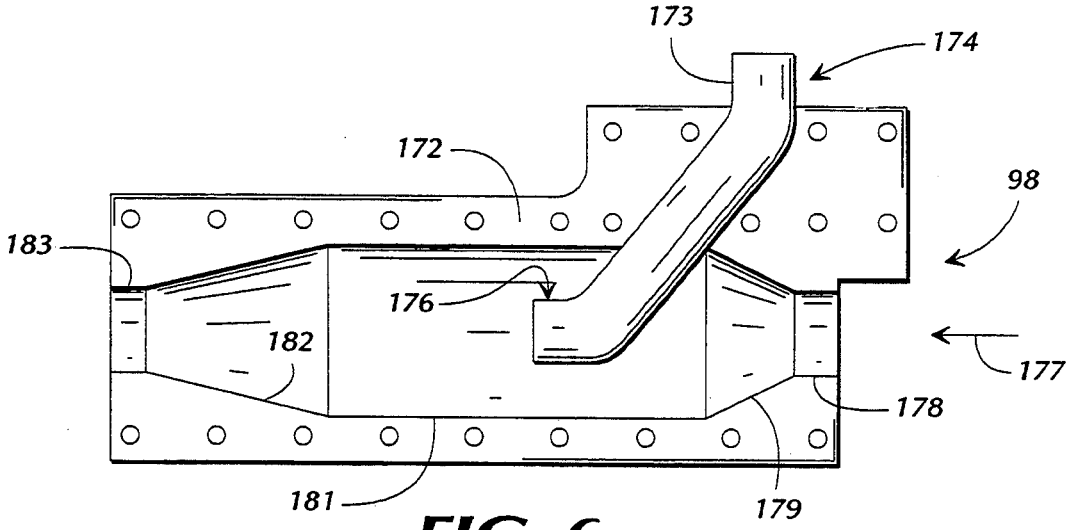
FIG. 6 is a side sectional illustration of an exhaust manifold portion of the apparatus of FIG. 1.
Figure 7:
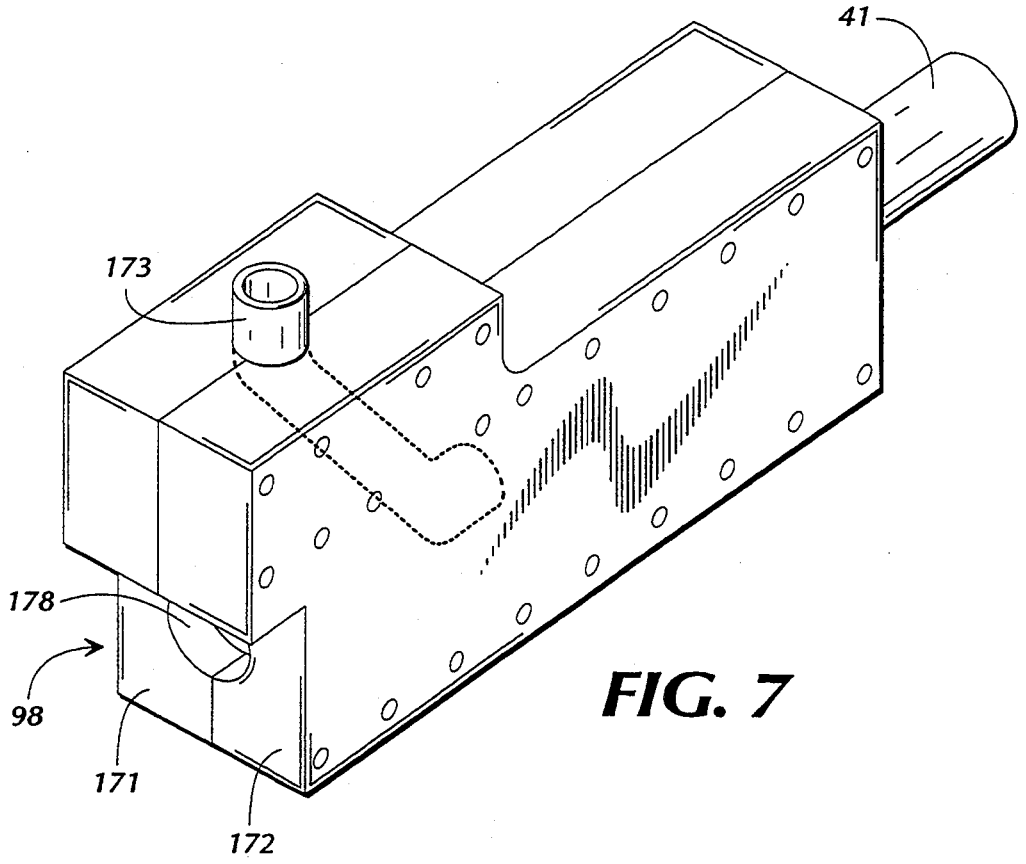
FIG. 7 is a perspective, schematic illustration of the exhaust manifold portion of FIG. 6.

Referring now to FIGS. 6 and 7, exhaust manifold 98 is shown and described in more detail. Exhaust manifold 98 is made of two half-pieces, 171 and 172. Each of these half-pieces is in the form of a joggled section and has been machined to mill out a recess for receiving an exhaust pipe 173. One end 174 of the exhaust pipe is connected to outlet port 118 so that an initial mixture of compressed air and dry ice pellets is passed through the outlet port 118 through the deck 51 into the exhaust pipe 173. This initial charge exits the exhaust pipe 173 at a second end 176 thereof. Looking at FIG. 6, the flow of compressed air from the compressed air source travels along the general direction of direction arrow 177. The exhaust manifold has a cylindrical inlet 178 and a divergent cone 179. The divergent cone 179 is followed by a cylindrical large chamber 181 and a convergent cone 182. The convergent cone 182 is followed by a cylindrical outlet 183 which is connected to delivery conduit 41 (see FIGS. 6 and 7).

Figure 8A:
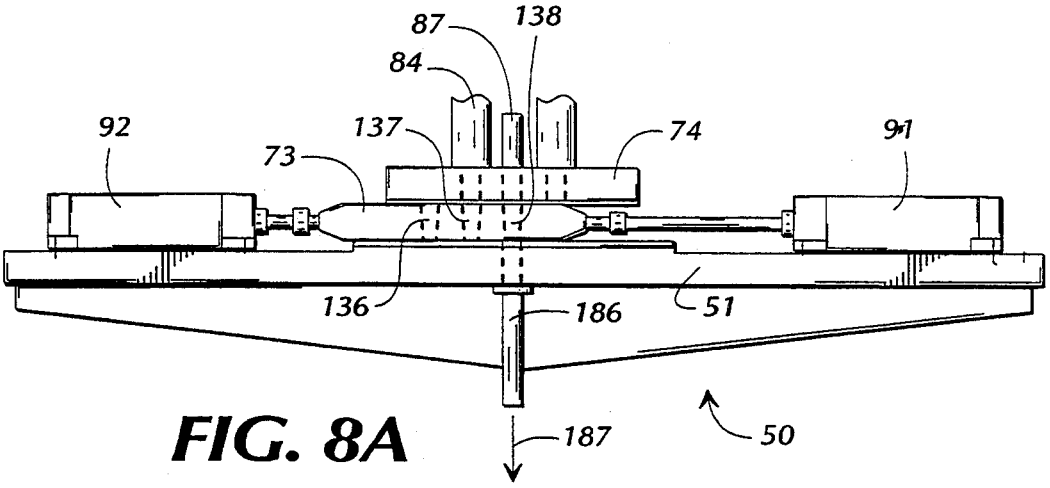
FIGS. 8A through 8C are schematic, side elevation views of a portion of the apparatus of FIG. 1 depicting one half cycle of movement of the transfer bar portion of the apparatus.
Figure 8B:
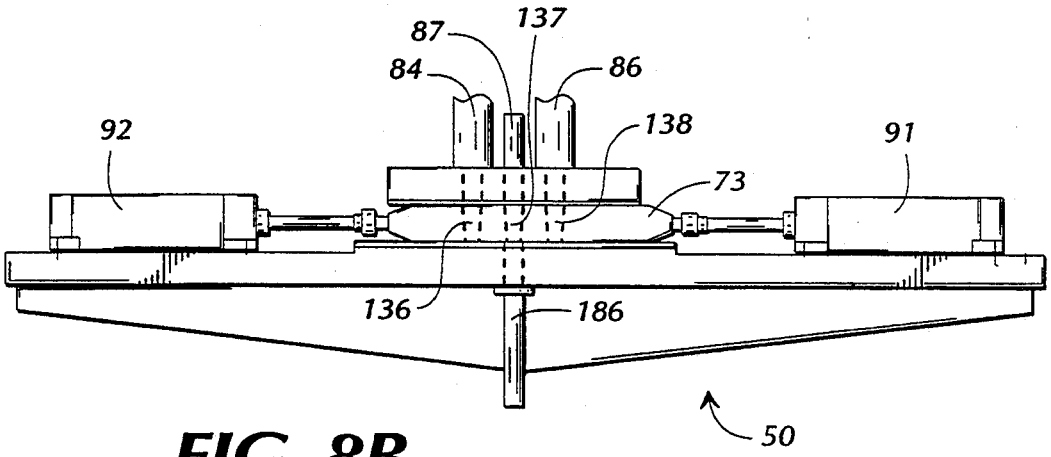
Figure 8C:
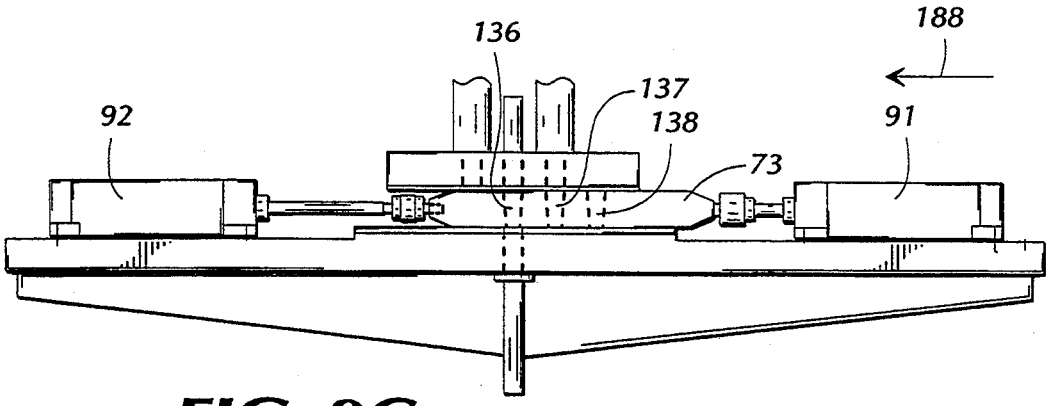

Having now described the structural details of the preferred embodiment, attention is turned to the operation of the device as depicted in FIGS. 8A–8C. FIGS. 8A, 8B, and 8C show, respectively, the configuration of the mixing device 50 as transfer bar 73 moves from a first position to a second position and then to a third position. It is to be understood that in operation the transfer bar 73 would then move from the third position back to the second position and to the first position to complete the cycle. Thus, FIGS. 8A through 8C depict one half-cycle of operation of the mixing device 50.

In FIG. 8A, the transfer bar 73 is in its left-most position. In this first position, the transfer chambers 136, 137, and 138 are positioned such that transfer chamber 136 is not in communication or registration with dry ice inlet conduit 84 or dry ice inlet conduit 86 or compressed air supply line 87. Rather, transfer chamber 137 is in registration with dry ice inlet conduit 84 for receiving a charge of dry ice pellets, while transfer chamber 138 is in registration with compressed air supply line 87 and an outlet conduit 186 which leads to exhaust pipe 173 of the exhaust manifold 98. In this position, a charge of dry ice pellets previously loaded into the transfer chamber 138 is entrained in and mixed with a blast of compressed air flowing through the compressed air supply line 87 through the upper plate 74, the transfer bar 73, and out through the deck 51. In this regard, the dry ice pellets and the compressed air move in the direction of direction arrow 187.

FIG. 8B shows the transfer bar 73 in a second position in which transfer chamber 136 receives a charge of dry ice pellets from dry ice conduit 84, while transfer chamber 137 is cleared of dry ice pellets by entraining the dry ice pellets in a blast of compressed air flowing from the compressed air supply line 87 through the mixing device 50 and out through the outlet 186. Meanwhile, transfer chamber 138 is positioned in registration with dry ice inlet conduit 86 for receiving a charge of dry ice pellets.

Referring now to FIG. 8C, a third position in the half-cycle of operation is depicted in which the transfer chamber 136 is evacuated of dry ice pellets, while the middle transfer chamber 137 receives a fresh charge of dry ice pellets and the remaining transfer chamber 138 is positioned to neither receive nor discharge dry ice pellets. After this, the transfer bar 73 goes back to the left in the direction of direction arrow 188 so that after the discharge of pellets from transfer chamber 136, transfer chambers 137 and 138 are subsequently evacuated and the dry ice entrained in the blast of air. This reciprocal motion takes place at a controllable rate of on the order of 120 cycles per minute. The back and forth motion generates heat, despite the self-lubricated wear blocks, which helps to keep the device from freezing up (seizing).

It should be understood that, according to the detent and sensor arrangement depicted in FIG. 5, compressed air is only supplied to the compressed air supply line 87 when one of the transfer chambers 136–138 is in at least partial alignment or communication with the compressed air inlet 87. This results in more uniform flow and tends to minimize back flow of compressed air up into the dry ice storage hopper.

Further, it should be readily apparent to those skilled in the art that the air cylinders 91 and 92, which are operated in pull only modes, are operated sequentially so that the transfer bar 73 is pulled first in one direction and then pulled back in the opposite direction in a repeated fashion to provide a reciprocating motion.

In reviewing the present disclosure, it should be readily apparent to one skilled in the art that the use of two air cylinders 91 and 92 is not absolutely necessary and that one air cylinder can be used instead. Also, the compressed air is normally contemplated as the compressed gas, in many situations compressed nitrogen, carbon dioxide, or other readily available gas is suitable. Furthermore, while the exhaust manifold is shown in a two-piece construction, such can be made as a casting and therefore in a one-piece configuration.

Those skilled in the art will recognize that the invention according to the present disclosure does not require the use of any electrical components, but rather can be operated entirely upon pneumatic controls. This is particularly useful in many situations in which a source of electricity is not readily available.

An apparatus according to the present invention also benefits from being simple and elegant in design. Such simple and elegant design leads to long life and reduced maintenance requirements. The present invention also results in a compact apparatus with a durable construction. It also requires a minimal number of moving parts, resulting in long life. The apparatus is suitable for use with a high energy/low air consumption nozzle arrangement and is highly portable for on-site cleaning. The device is easily operated and is economical in operation, maintenance, and construction.

While the invention has been disclosed in preferred forms, it will be apparent to those skilled in the art that many modifications, additions, and deletions can be made therein without departing from the spirit and scope of the invention as set forth in the following claims.

What is claimed is:

1. A particle blast cleaning apparatus for use with sublimable blast media, a source of compressed gas, and a discharge nozzle, said apparatus comprising:

mixing means for mixing sublimable media with compressed gas, said mixing means including:

a lower section having an outlet port formed therein;

an upper section positioned over and spaced apart from said lower section and having two sublimable media inlet ports and a compressed gas inlet port aligned with said outlet port of said lower section and positioned between said sublimable media inlet ports; and a reciprocating transfer member mounted between said lower section and said upper section for reciprocal movement and having at least two transfer chambers for receiving sublimable media from said sublimable media inlet ports and for transporting the sublimable media to adjacent said outlet port.

2. An apparatus as claimed in claim 1 further comprising control means for directing compressed gas to said compressed air inlet port substantially only when one of said at least two transfer chambers in said reciprocating transfer member is at least partially aligned with said inlet port.

3. An apparatus as claimed in claim 1 further comprising dynamic seal means for providing a fluid seal between said reciprocating transfer member and said lower section and between said reciprocating transfer member and said upper section, said dynamic seal means comprising guide means for movably locating said upper section relative to said lower section to maintain said upper section in a substantially parallel, spaced apart relationship relative to said lower section, said dynamic seal means further comprising means for resiliently urging said upper section towards said lower section.

4. An apparatus as claimed in claim 3 wherein said means for resiliently urging said upper section towards said lower section comprises at least one air cylinder mounted to said upper and lower sections for urging said upper and lower sections toward each other.

5. An apparatus as claimed in claim 1 further comprising a first exhaust conduit having an open end in fluid communication with said outlet port and an exhaust manifold in communication with said first exhaust conduit, said exhaust manifold also being in fluid communication with the source of compressed gas, said exhaust manifold comprising a flow restrictor section such that compressed gas flowing into said exhaust manifold from the source of compressed gas experiences a pressure drop as it flows into said exhaust manifold, whereby back pressure at said open end of said first exhaust conduit is minimized, thereby facilitating even flow through the exhaust manifold.

6. An apparatus as claimed in claim 1 further comprising pressure relief means communicating with said transfer chambers for venting pressure in said transfer chambers when said transfer chambers are not in alignment with said compressed gas inlet port.

7. An apparatus as claimed in claim 1 wherein said transfer chambers are generally tapered from a first opening near a top end portion thereof to a smaller, second opening near a bottom portion thereof to ease introduction of sublimable media into said transfer chambers with said transfer chambers adjacent said inlet ports.

8. An apparatus as claimed in claim 1 wherein said transfer chambers are generally circular in cross section at a bottom end portion thereof and are generally ovoid near a top portion thereof to ease introduction of sublimable media into said transfer chambers with said transfer chambers adjacent said inlet ports.

9. An apparatus as claimed in claim 2 wherein said control means comprises position sensor means for determining whether one of said transfer chambers is in fluid communication with said compressed gas inlet port and for controlling the flow of compressed gas to said compressed gas inlet port only in response to sensing that one of said transfer chambers is in fluid communication with said compressed gas inlet port.

10. An apparatus as claimed in claim 1 further comprising first means for moving said reciprocating transfer member in a first direction and second means for moving said reciprocating transfer member in a second direction, opposite said first direction.

11. An apparatus as claimed in claim 10 wherein said first and second means for moving comprise air cylinders adapted for pulling only.

12. A particle blast cleaning apparatus for use with sublimable blast media, a source of compressed gas, and a discharge nozzle, said apparatus comprising:

mixing means for mixing sublimable media with compressed gas, said mixing means including:

a lower section having an outlet port formed therein;

an upper section positioned over and spaced apart from said lower section and having two sublimable media inlet ports and a compressed gas inlet port;

a reciprocating transfer member mounted between said lower section and said upper section for reciprocal movement and having at least two transfer chambers for receiving sublimable media from said sublimable media inlet ports and for transporting the sublimable media to adjacent said outlet port; and control means operative for controlling the flow of compressed gas to said compressed gas inlet port such that compressed gas is provided to said compressed gas inlet port substantially only when at least one of said transfer chambers is in fluid communication with said compressed gas inlet port.

13. An apparatus as claimed in claim 12 further comprising dynamic seal means for providing a fluid seal between said reciprocating transfer member and said lower section and between said reciprocating transfer member and said upper section, said dynamic seal means comprising guide means for movably locating said upper section relative to said lower section to maintain said upper section in a substantially parallel, spaced apart relationship relative to said lower section, said dynamic seal means further comprising means for resiliently urging said upper section towards said lower section.

14. An apparatus as claimed in claim 13 wherein said means for resiliently urging said upper section towards said lower section comprises at least one air cylinder mounted to said upper and lower sections for urging said upper and lower sections toward each other.

15. An apparatus as claimed in claim 12 further comprising a first exhaust conduit having an open end in fluid communication with said outlet port and an exhaust manifold in communication with said first exhaust conduit, said exhaust manifold also being in fluid communication with the source of compressed gas, said exhaust manifold comprising a flow restrictor section such that compressed gas flowing into said exhaust manifold from the source of compressed gas experiences a pressure drop as it flows into said exhaust manifold, whereby back pressure at said open end of said first exhaust conduit is minimized, thereby facilitating even flow through the exhaust manifold.

16. An apparatus as claimed in claim 12 further comprising pressure relief means communicating with said transfer chambers for venting pressure in said transfer chambers when said transfer chambers are not in alignment with said compressed gas inlet port.

17. An apparatus as claimed in claim 12 wherein said control means comprises position sensor means for determining whether one of said transfer chambers is in fluid communication with said compressed gas inlet port and for controlling the flow of compressed gas to said compressed gas inlet port only in response to sensing that one of said transfer chambers is in fluid communication with said compressed gas inlet port.

18. An apparatus as claimed in claim 12 further comprising first means for moving said reciprocating transfer member in a first direction and second means for moving said reciprocating transfer member in a second direction, opposite said first direction.

19. An apparatus as claimed in claim 18 wherein said first and second means for moving comprise air cylinders adapted for pulling only.

20. A particle blast cleaning apparatus for use with sublimable blast media, a source of compressed gas, and a discharge nozzle, said apparatus comprising:

mixing means for mixing sublimable media with compressed gas, said mixing means including:

a lower section having an outlet port formed therein;

an upper section positioned over and spaced apart from said lower section and having at least one sublimable media inlet port and a compressed gas inlet port aligned with said outlet port of said lower section;

a reciprocating transfer member mounted between said lower section and said upper section for reciprocal movement and having at least two transfer chambers for receiving sublimable media from said at least one sublimable media inlet port and for transporting the sublimable media to adjacent said outlet port; and dynamic seal means for providing a fluid seal between said reciprocating transfer member and said upper and lower sections, said dynamic seal means comprising means for resiliently urging said upper section toward said lower section.

21. An apparatus as claimed in claim 20 wherein said dynamic seal means comprises guide means for movably locating said upper section relative to said lower section to maintain said upper section in a substantially parallel, spaced apart relationship relative to said lower section.

22. An apparatus as claimed in claim 20 wherein said means for resiliently urging said upper section towards said lower section comprises at least one air cylinder mounted to said upper and lower sections for urging said upper and lower sections toward each other.

23. A particle blast cleaning apparatus for use with sublimable blast media, a source of compressed gas, and a discharge nozzle, said apparatus comprising:

mixing means for mixing sublimable media with compressed gas, said mixing means including:

a lower section having an outlet port formed therein;

an upper section positioned over and spaced apart from said lower section and having at least one sublimable media inlet port and a compressed gas inlet port;

a reciprocating transfer member mounted between said lower section and said upper section for reciprocal movement and having at least two transfer chambers for receiving sublimable media from said at least one sublimable media inlet ports and for transporting the sublimable media to adjacent said outlet port; and a first exhaust conduit having an open end in fluid communication with said outlet port and an exhaust manifold in communication with said first exhaust conduit, said exhaust manifold also being in fluid communication with the source of compressed gas, said exhaust manifold comprising a flow restrictor section such that compressed gas flowing into said exhaust manifold from the source of compressed gas experiences a pressure drop as it flows into said exhaust manifold, whereby back pressure at said open end of said first exhaust conduit is minimized, thereby facilitating even flow through the exhaust manifold.

* * * * *